US006318266B1

(12) United States Patent
Weill

(10) Patent No.: US 6,318,266 B1
(45) Date of Patent: Nov. 20, 2001

(54) INK FLOW RATE INDICATOR

(75) Inventor: David Weill, Jerusalem (IL)

(73) Assignee: Scitex Corporation Ltd., Herzelia (IL)

( * ) Notice: Subject to any disclaimer, the term of this patent is extended or adjusted under 35 U.S.C. 154(b) by 0 days.

(21) Appl. No.: 09/085,561

(22) Filed: May 27, 1998

Related U.S. Application Data

(63) Continuation-in-part of application No. 08/627,434, filed on Apr. 4, 1996, now abandoned.

(30) Foreign Application Priority Data

Apr. 11, 1995 (IL) ..... 113336

(51) Int. Cl.[7] ..... B41F 1/10; B41F 31/02; B41F 5/16; B41F 5/18; B41M 1/14

(52) U.S. Cl. ..... 101/490; 101/366; 101/183; 101/210; 101/211

(58) Field of Search ..... 101/365, 183, 101/181, 212, 216, 174, 177, 184, 136, 157, 138–140, DIG. 45, 210, 211, 490, 366; 364/469.03; 250/559.39; 395/101; 358/501, 504

(56) References Cited

U.S. PATENT DOCUMENTS 4,852,485 * 8/1989 Brunner ..... 101/211
4,881,181 * 11/1989 Jeschke et al. ..... 101/365
4,918,622 * 4/1990 Granger et al. ..... 364/518
4,955,290 * 9/1990 Kipphan et al. ..... 101/183
5,543,940 * 8/1996 Sherman ..... 358/518
5,625,758 * 4/1997 Schneider et al. ..... 395/114
5,636,330 * 6/1997 Barak ..... 395/109
5,689,425 * 11/1997 Sainio et al. ..... 101/181
5,774,635 * 6/1998 Kuusisto et al. ..... 395/106
5,903,712 * 5/1999 Wang et al. ..... 395/109
5,967,049 * 10/1999 Seymour et al. ..... 101/484

FOREIGN PATENT DOCUMENTS

495563 * 7/1992 (EP) .

OTHER PUBLICATIONS

Adams, Michael J. et al., "Printing Technology", 4th Edition, 1996, pp335–337, 362–364, Delmar Publishers.

* cited by examiner

*Primary Examiner*—Kimberly Asher
(74) *Attorney, Agent, or Firm*—Eitan, Pearl, Latzer & Cohen-Zedek

(57) ABSTRACT

A method for providing indications for conditioning ink flow valves of at least one inking unit of a printing press. The printing area of the inking unit is divided into a multiplicity of inking zones each supplied by one ink flow valve in order to prescribe a predetermined rate of ink flow for each ink zone in said at least one inking unit. The method includes determining by calculating, from a digital image being processed for printing, a representative ink density value for each ink zone and for each color separation and furnishing the ink flow valves respectively with the values for regulating the flow in the ink zones.

10 Claims, 4 Drawing Sheets

(1 of 4 Drawing Sheet(s) Filed in Color)

| | | | | | | | | | | | | | | |
|---|---|---|---|---|---|---|---|---|---|---|---|---|---|---|
| | | | | | | | 56 | | | | 55 | | | 53 |
| | 75% | 71% | 68% | 73% | 73% | 67% | 59% | 52% | 47% | 44% | 45% | 44% | 43% | 28% |
| | 64% | 61% | 58% | 65% | 62% | 56% | 48% | 45% | 38% | 37% | 37% | 34% | 31% | 15% |
| | 67% | 65% | 64% | 68% | 67% | 59% | 51% | 45% | 46% | 46% | 39% | 33% | 29% | 14% |
| | 68% | 74% | 70% | 77% | 73% | 69% | 61% | 54% | 47% | 44% | 45% | 41% | 38% | 18% |

INK FLOW RATE INDICATOR

RELATED APPLICATION

This application is a continuation in part application of patent application Ser. No. 08/627,434 filed Apr. 4, 1996, now abandoned.

FIELD OF THE INVENTION

The present invention relates generally to control of the ink flow of a printing press.

BACKGROUND OF THE INVENTION

The prior art printing process is illustrated in FIG. 1 to which reference is now made. Each individual color page to be printed is prepared on a pre-press device 10. When the designer finishes designing the page, the pre-press device 10 creates four digitized versions 12 of the page, one for each of the four color separations cyan, magenta, yellow and black (C, Y, M, and K). The digitized versions of the page will be known herein as "separation files" 12.

When the designer has finished preparing all of the pages of the printed publication (magazine, newspaper, brochure, etc.) to be printed, he provides the separation files 12 for the entirety of pages to an imposition device 14 (such as provided within the WHISPER I/O Station manufactured by Scitex Corporation Ltd. of Herzlia, Israel) which "imposes" the pages into "signatures" 16. Each signature typically has press marks 18 and eight pages on it where the order that the eight pages are laid out is a function of how the printing press will fold the press sheet after printing. The imposition device 14 produces four data files of the signature, one for each color separation.

The four files representing the signature 16 are provided to a film plotter 20 (such as the DOLEV 800 plotter manufactured by Scitex Corporation Ltd.) which plots each version of the signature 16 onto a film. The result are films 22 of the separations of the signature 16. Blue-line proofs 26 are provided by blue line proofer 26 from films 22. Blue-line proofs 26 is a blue and white print of the signature 16 and is utilized to ascertain that the text is correct, that the placement of the various elements of the pages are correct and aligned and that the general impression of the pages is correct. If it is not, the designer needs to make changes at the pre-press device 10 and the process needs to be repeated.

To determine whether or not the colors to be printed are the desired colors, the films 22 are sent to a Chromalin proofer 26 as produced by Dupont, Delaware, USA for producing a color CHROMALIN proof 29. The film creation process is repeated if the colors are in any way unacceptable.

If the blue-line proof 26 and the color chromalin 29 indicate that there are no problems, the films 22 are provided to a printing press 30 for printing. Each film 22 is utilized to create a press plate and the press plates are placed on separate inking units of the press, onto which the ink of the proper color (cyan, magenta, yellow or black) will be spread.

Since the color varies widely across a page and across a signature, each press inking unit is divided into a plurality of "zones" where each zone has a separate ink flow regulator 32, known as a "zone valve". Each zone valve ensures that the amount of ink which is spread across its zone is compatible with the amount of color desired.

Usually, a press operator initially sets the zone valves 32 by looking at the colors in the Chromalin proof 29. He then prints one sheet with the initial settings, to view the final result. If the colors are smeared in one zone, there is too much ink available and he will have to adjust down the zone valve 32 for the problematic zone. Similarly, if the color is too light, he will have to open up the zone valve 32. The printing process is repeated for another sheet until the desired affect is achieved. After that, the printing press is operated with only spot checks to determine that the ink flow in each zone remains correct.

The Heidelberg Speedmaster 72 printing press, manufactured by Heidelberg Druckmaschinen AG of Germany, has a plurality of zone valves 32 (or fountain keys) which can be controlled directly or remotely. Presses may have 8 to 30 such zone valves.

It will be appreciated that, if the density of a given color is consistent across the zone, the setting for the zone valve 32 is straightforward. However, if the density of the color varies widely over a zone, it is difficult for the press operator to determine how much ink flow to provide.

U.S. Pat. No. 5,128,879 describes a method and apparatus which acquires the zone valve states and adjusts them automatically. The settings of the zone valves are calculated from the color density values provided in the page initially created by the pre-press devices 10. The calculated zone valve settings are forwarded directly to the printing press, without intervention of the press operator.

European Patent Publication 495563 A2 describes an integrated computerized system for use in printing assigned to the common assignees of the present invention. The disclosure of its U.S. counterpart, allowed application No. 07/650,249 now U.S. Pat No. 5,875,288 is incorporated herein by reference. The system includes apparatus for providing and digitally storing at least one digital representation of at least one page. The digital representation is imposed and arranged in accordance with a desired plate layout to define a plate image. Press set-up apparatus then extracts the digital representation and providing press set-up data to a printing press.

SUMMARY OF THE PRESENT INVENTION

This invention is useful in printing presses which are manually (or remotely) controlled. It is an object of the present invention to provide the press operator with positive indication of the initial setting for the printing press zone valves. This is achieved by creating a proof which provides, in addition to a proof of the signature (placement, text, graphics), ink density indications for each zone of each color separation.

According to a preferred embodiment of the invention, there is provided a method for providing indications for conditioning or presetting ink flow valves of at least one inking unit of a printing press. The printing area of the inking unit is divided into a multiplicity of inking zones each supplied by one ink flow valve in order to prescribe a predetermined rate of ink flow for each ink zone in said at least one inking unit. The method includes determining by calculating, from a digital image being processed for printing, a representative ink density value for each ink zone and for each color separation and furnishing the ink flow valves respectively with the values for regulating the flow in the ink zones.

The ink density indications can be provided in any way. In one embodiment, the ink density indications are provided in strips, one per ink color, below the signature. The strips are divided into sections, one per zone, and each section has both a listing of the ink density of the zone and a swatch of ink having the average color density.

Moreover, in accordance with the preferred embodiment of the present invention, the representative ink densities are determined by dividing the image to be printed into a plurality of image zones associated with the inking zones of the press and determining a representative ink density of each ink color in each image zone. The operator is typically furnished with a reproduction of the representative ink densities as color proofs or alternatively on paper.

Furthermore, in accordance with the preferred embodiment of the present invention, the reproducing of the representative ink densities includes the step of creating color strips of the representative ink densities. The color strips have strip zones each of which is associated with one of the image zones. The strip zone has the representative density of the associated image zone. Numerical indications of the representative ink densities can be included. The step of reproducing can include the step of plotting the representative ink densities on a color proof or onto color separation films from which a color proof is produced.

Furthermore, in accordance with a second preferred embodiment of the present invention, there is provided a method of setting the amount of ink flow for each zone valve of a printing press for an image to be printed. The method includes determining, from the image to be printed, representative ink densities for each ink zone and for each separation, visually reproducing the representative densities and setting the amount of ink flow of each zone valve in accordance with the color of the corresponding representative ink density. Setting the amount of ink flow can provide the initial setting of the zone valves.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

The present invention will be understood and appreciated more fully from the following detailed description taken in conjunction with the drawings in which.

DETAILED DESCRIPTION OF PREFERRED EMBODIMENTS

The present invention provides a press operator with indications, typically on a portable sheet of paper, of the ink flow rates to be set in each of the zones of the press. The ink-flow indication is provided as a swatch of ink, which has the desired density, accompanied by a percentage showing the setting of valve 32, which according to the present invention may be carried out in each zone before beginning the printing job. Since the press operator generally knows the relationship between the swatch color and the setting of the zone valves, he can set each valve 32 in accordance with the percentage marked, using the corresponding ink-swatch as confirmation. The press operator typically then fine tunes the zone valves 32 as in the prior art. It will be appreciated that the visual indications of the present invention can be utilized at any point during the operation of the press.

Figure 2A:
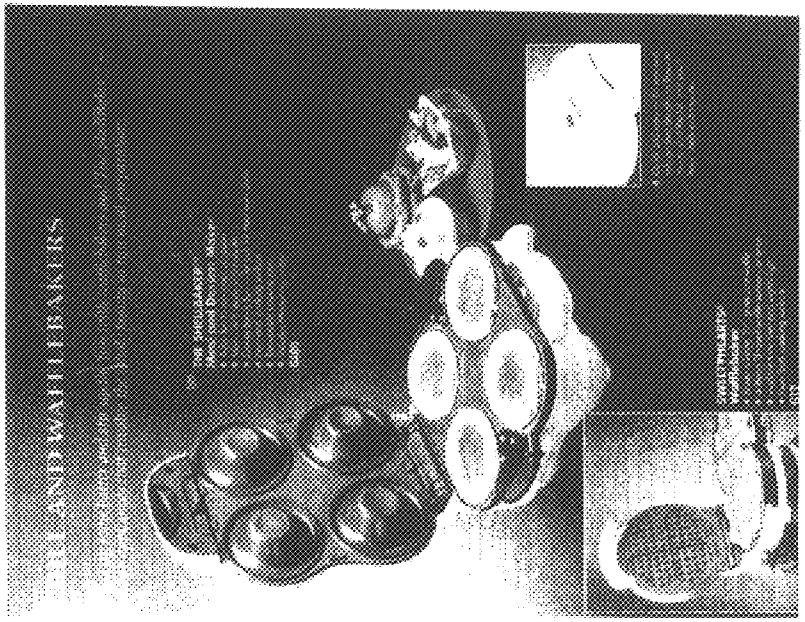
FIG. 2A is a color illustration of a part of a color proof having ink density strips thereon, said ink density strips being constructed in accordance with preferred embodiments of the present invention.
Figure 2A:
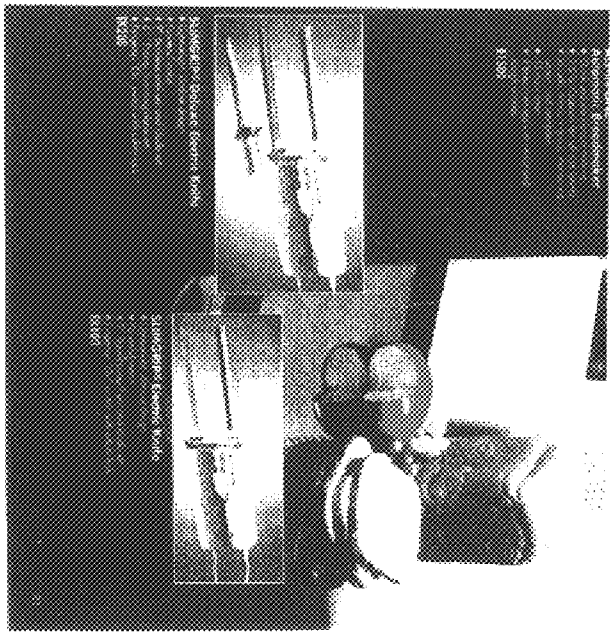
Figure 2B:
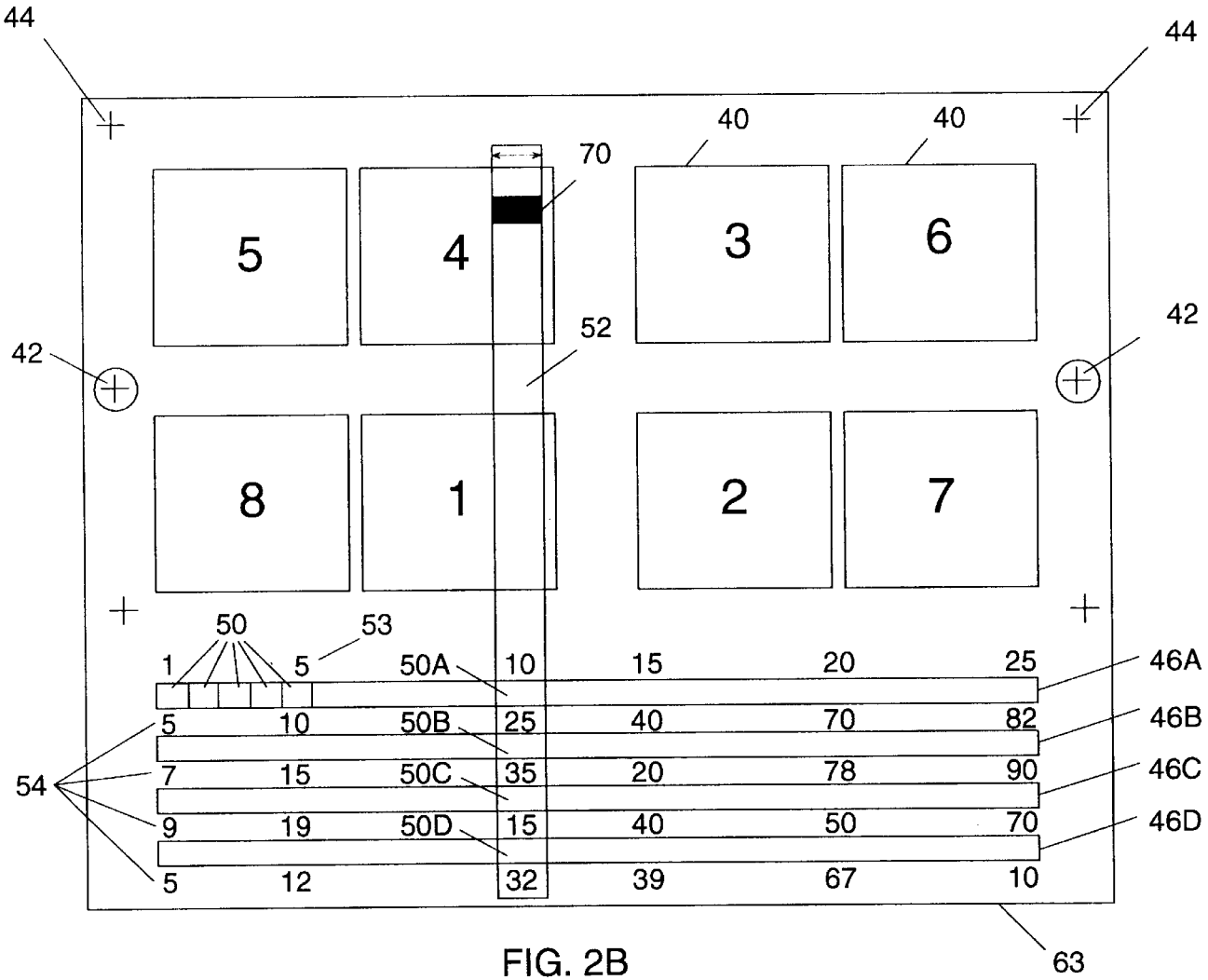
FIG. 2B is a schematic illustration of the complete proof of FIG. 2A, providing reference numerals to the elements of FIG. 2A.

Reference is now made to FIGS. 2A and 2B. FIGS. 2A and 2B provide an example of the present invention. FIG. 2A is a color illustration of part of a color 63 proof of a signature which also comprises strips of ink swatches having the representative density for each zone of the signature and FIG. 2B is a schematic illustration of the entire proof 63 of FIG. 2A indicating its elements and reference numerals.

It will be appreciated that the present invention is operative for all types of "pages" to be printed; thus, it can be implemented for a signature of many pages, as described hereinbelow, or it can be implemented for printing a poster of a single page.

As shown in FIGS. 2A and 2B, the proof has signature elements and color strips. The signature elements include eight pages 40, registration marks 42 and folding marks 44. There are four color strips, labeled 46*a,* 46*b,* 46*c* and 46*d,* one for each ink color, cyan, magenta, yellow and black, respectively. If other ink colors are utilized, the strips 46 will have the approximate colors of the inks utilized.

The color strips 46 are typically placed below or above the signature and the strips 46 are typically aligned with one another. Each color strip 46 is divided into swatches 50 where each swatch 50 of each strip 46 corresponds to a zone 52 of the signature thereabove or below. One zone 52 is illustrated in FIG. 2B and is shown associated with swatches 50*a,* 50*b,* 50*c* and 50*d* of strips 46*a,* 46*b,* 46*c,* and 46*d,* respectively. The number of swatches correspond to the number of zone valves of the specific press in use.

Swatch 50*a* has a density of cyan which is the representative density of cyan in zone 52. For the purposes of this description, "density" may be defined as the ink coverage as a percentage. Similarly, swatches 50*b,* 50*c* and 50*d* have densities of magenta, yellow and black, respectively, which are the representative densities of magenta, yellow and black in zone 52. The representative densities can be determined in any of a number of ways, some of which are described hereinbelow.

Over the color strip area is a notation 53 representing the number of the zone valve 32 to which each swatch refers. Below each zone of each color strip are numerical indications 54, representing the zone valve positions as a percentage of the full open position. Alternatively, the indications 54 can indicate the ink density of the swatch 50 thereabove. Thus, swatches 50*a,* 50*b,* 50*c* and 50*d* have numerical indications, 54 for example, of 25%, 35%, 15% and 32%, respectively.

It will be appreciated that the press operator can determine, from both the visual indications of the representative color density and the numerical indications, what the appropriate initial setting for the zone valves 32 of each zone should be, and thus, condition or preset each of the zone valves 32.

Figure 3:
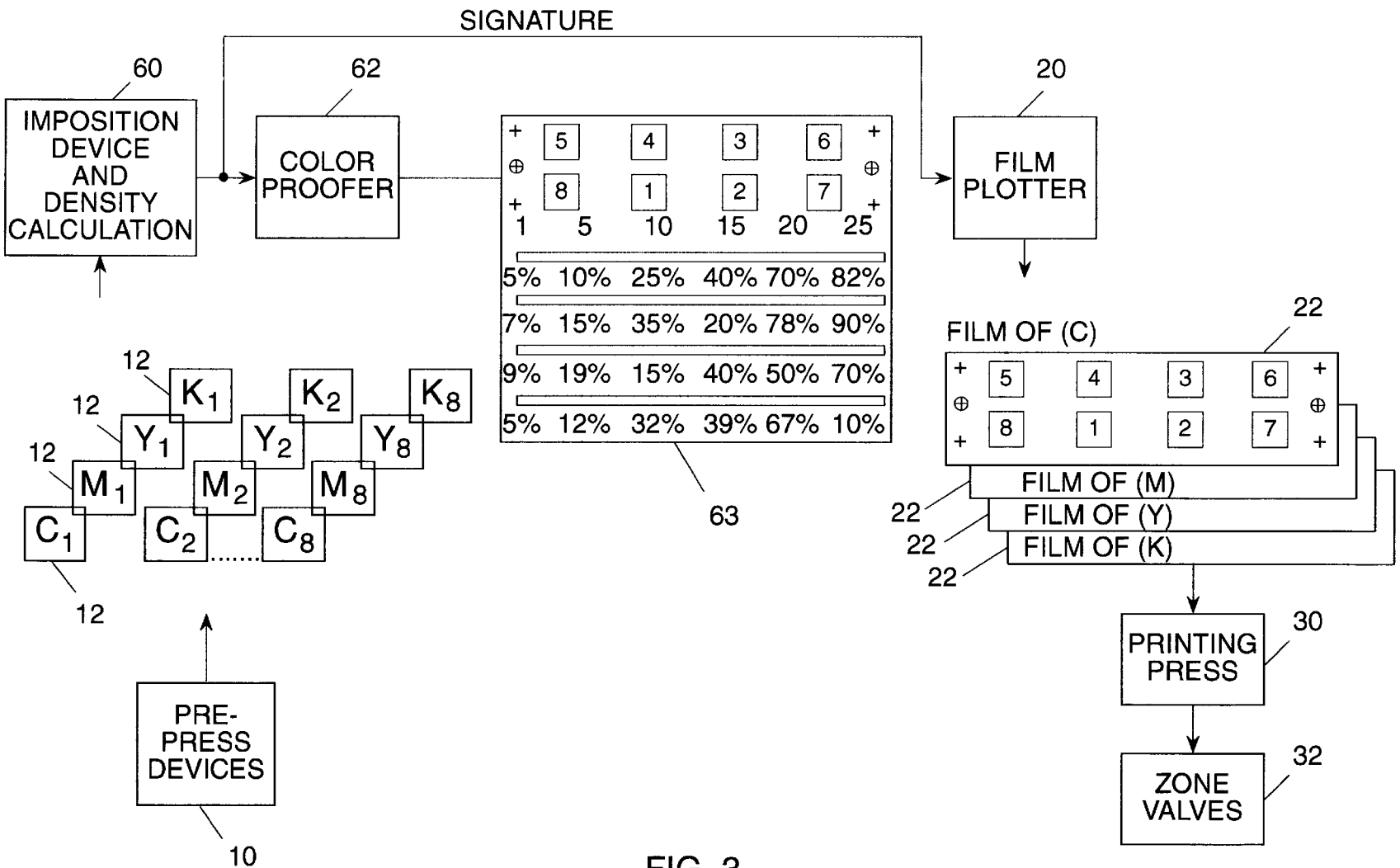
FIG. 3 is a schematic block diagram illustration of a first work flow for creating the color proof of FIG. 2A.

Reference is now made to FIG. 3 which is a schematic block diagram illustration of a first work flow for creating the color proof 63 of FIG. 2A. Elements which are similar to those of FIG. 1 have the same reference numerals.

Figure 1:
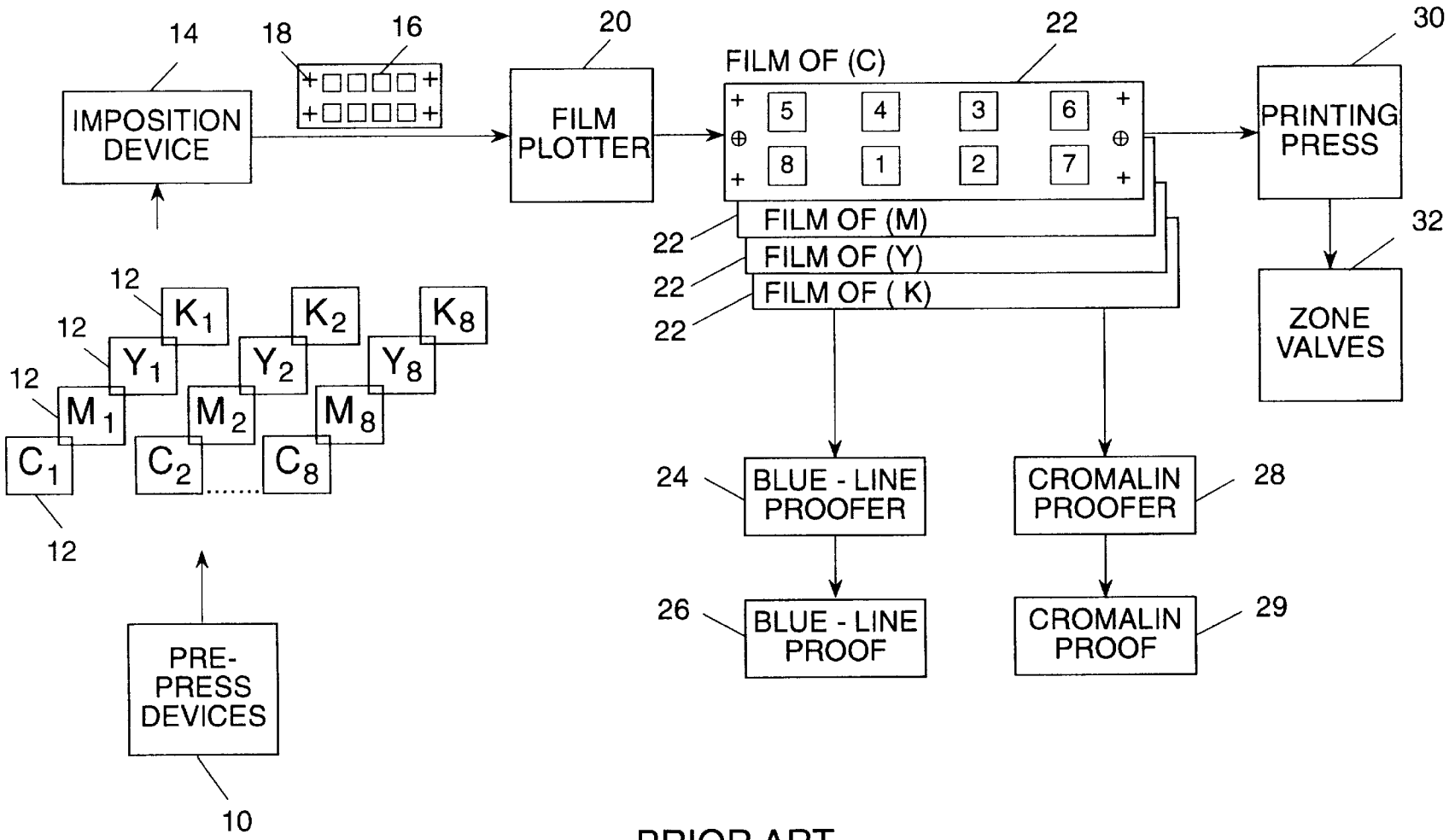
PRIOR ART FIG. 1
FIG. 1 is a schematic block diagram illustration of a prior art work flow for creating and printing color documents.

As in the prior art work flow of FIG. 1 the workflow of the invention as shown in FIG. 3 indicates that, the pre-press devices 10 produce color separations 12 of a plurality of pages. Then, in the prior art, an imposition device 14 imposes the page into a signature, whereas in the present invention, the imposition device 14, after having composed the pages, provides them further to a density calculating device 61, before being processed further in devices 62 and 20. The device 61 determines a representative density value for each color and each zone of the imposed signature, as detailed hereinbelow. Each density value represents a zone allocated on the image, which corresponds to an ink zone of a printing machine inking unit in a printing press. According to the preferred embodiment, device 61 prepares strips, the color density value of which is based on the color density value placing a swatch of the calculated density above or below the associated zone and the numerical indications. Unit 61 then provides the signature and color strip information to a color printer 62, such as the 650C color plotter manufactured by Hewlett-Packard Company of Boise, Id., to produce the color proof of FIG. 2A. If the color proof of FIG. 2A is acceptable, device 61 also provides just the signature information to film plotter 20 which then plots the films 22. The films are converted into plates which are then placed on the printing press 30 for printing. With the color proof 63 of FIG. 2A, produced by proofer 62, the press operator can set the initial setting of zone valves 32.

In one embodiment of the present invention, the representative densities are per color averages of the densities in each zone. The averages are determined by device 61 as follows:

1. First the imposed signature is divided into vertical zones 52 (FIG. 2B) the number of which reflects the number of zone valves in an inking unit of the press on which the signature intended to be printed;
2. Subsequent to their allocation each vertical zone 52 is divided into a multiplicity of squares 70 and the average color density of every square, for each color separation, is derived from the digital images of the color separations 12.
3. The plurality of values thus obtained, one from each of the squares 70 comprising a vertical zone 52 are averaged, thereby obtaining a single value for an entire strip.

Consequently, each value representing a single vertical zone is then used according to a preferred embodiment, for assigning a specific color density manifested in swatches 50. To achieve this, a transform function is employed, linking between the strip value and the color density scale, with instruction accordingly being sent to the color proofer 62.

According to a preferred embodiment of the invention, device 61 exists virtually in software and all the operations involved are numeric calculations and other operations implemented by a computer such as a Personal Computer or a Workstation.

It will be appreciated by persons skilled in the art that the present invention is not limited to what has been particularly shown and described hereinabove. Rather the scope of the present invention is defined by the claims which follow.

What is claimed is:

1. A method of setting initial ink flow rates in a printing press having a plurality of inking units for printing a plurality of ink colors, each of said inking units divided into a plurality of inking zones, the method comprising the steps of:

providing an image to be printed;

converting said image to be printed into a plurality of digital representations of said image in accordance with a plurality of corresponding color separations;

dividing said plurality of digital representations into divisions corresponding to said plurality of ink zones;

calculating the representative ink densities for each of said plurality of said colors in each of said plurality of said ink zones; and for each of said colors in each of said plurality of ink zones;

creating a proof having a visual representation of said digital image and having strips with said representative ink densities; and providing indicia corresponding to a preferred setting for said initial ink flow rate in each zone in accordance with the corresponding representative ink density.

2. The method of claim 1, wherein said step of creating said proof includes producing a printed article including said visual representation of said image and said strips.

3. The method of claim 1, wherein said step of creating said proof includes the step of plotting said representative ink densities on said proof.

4. The method of claim 1, wherein said plurality of colors include cyan, magenta, yellow and black.

5. The method of claim 1, wherein said image to be printed corresponds to a page.

6. The method of claim 1, wherein said step of converting said image into a plurality of digital representations includes converting said image into at least four series of digital files, each of said digital files corresponding to one color.

7. The method of claim 6, additionally comprising compiling each of said at least four series of digital files to create an imposed signature for each of said color separations.

8. The method of claim 1, wherein said step of converting said image into a plurality of digital representations includes converting said image into at least four imposed signatures, each of said imposed signatures corresponding to one color.

9. A method of providing visual indications for presetting ink flow rates in inking units of a printing press for printing an image, whereas the printing area of said inking units are divided into a plurality of ink zones each supplied by an ink flow valve in order to prescribe a predetermined rate of ink flow for each ink zone in said inking units, the method comprising the steps of:

providing an image to be printed;

converting said image to be printed into a plurality of digital representations of said image in accordance with a plurality of corresponding color separations;

creating divisions in said plurality of digital representations of said image, said divisions corresponding to said plurality of ink zones;

calculating the representative ink density value for each of said ink zones from said plurality of digital representations of said image; and for each color separation;

providing visual indicia of said representative ink density values for each of said ink zones, said indicia for presetting ink flow rates in each of said ink zones by steps including:

producing a printed article, said printed article including a diagram of said visual indicia of said representative ink density values for each of said ink zones, said visual indicia including numerals and color strips.

10. The method of claim 9, wherein said printed article includes a proof of said image to be printed.

* * * * *